United States Patent [19]

Williams

[11] 4,015,810

[45] Apr. 5, 1977

[54] AUTOMATIC FLOAT-OFF STORAGE BRACKET

[75] Inventor: Wayne E. Williams, Hollywood, Fla.

[73] Assignee: ACR Electronics, Inc., Hollywood, Fla.

[22] Filed: Dec. 15, 1975

[21] Appl. No.: 640,441

[52] U.S. Cl. ..... 248/311.1; 211/60 R

[51] Int. Cl.[2] ..... A47K 1/08

[58] Field of Search ..... 248/309, 310, 311, 312, 248/111; 211/60 R, 75

[56] References Cited

UNITED STATES PATENTS

| | | | |
|---|---|---|---|
| 1,129,198 | 2/1915 | Iddings | 248/311 R |
| 1,727,213 | 9/1929 | McMullen | 248/311 R |
| 1,972,532 | 9/1934 | McMillan | 248/111 |
| 2,017,319 | 10/1935 | McMullen | 248/311 R |
| 3,008,679 | 11/1961 | Powell | 248/311 R |
| 3,033,405 | 5/1962 | Adell | 248/311 R |
| 3,421,632 | 1/1969 | Wood | 211/60 R |

*Primary Examiner*—Robert A. Hafer
*Attorney, Agent, or Firm*—Darby & Darby

[57] ABSTRACT

A mounting bracket for engaging a stored module for float-free release by engaging an enlarged upper portion and the lower portion of the module until after a first upward displacement of the module to then allow free lateral movement of the module. Only the enlarged upper portion of the module is engaged by a stationary upper retainer, so that after the upward displacement, the upper retainer leaves the body portion of the module free for lateral exit. A lower retainer engages the lower module portion. Because these retainers do not act frictionally, they allow unhampered upward movement of the module within the bracket.

15 Claims, 9 Drawing Figures

FIG. 6
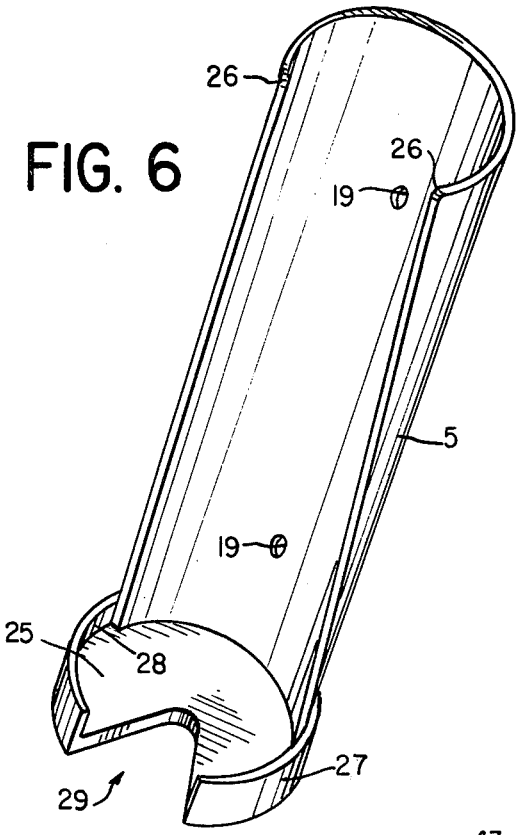
FIG. 7
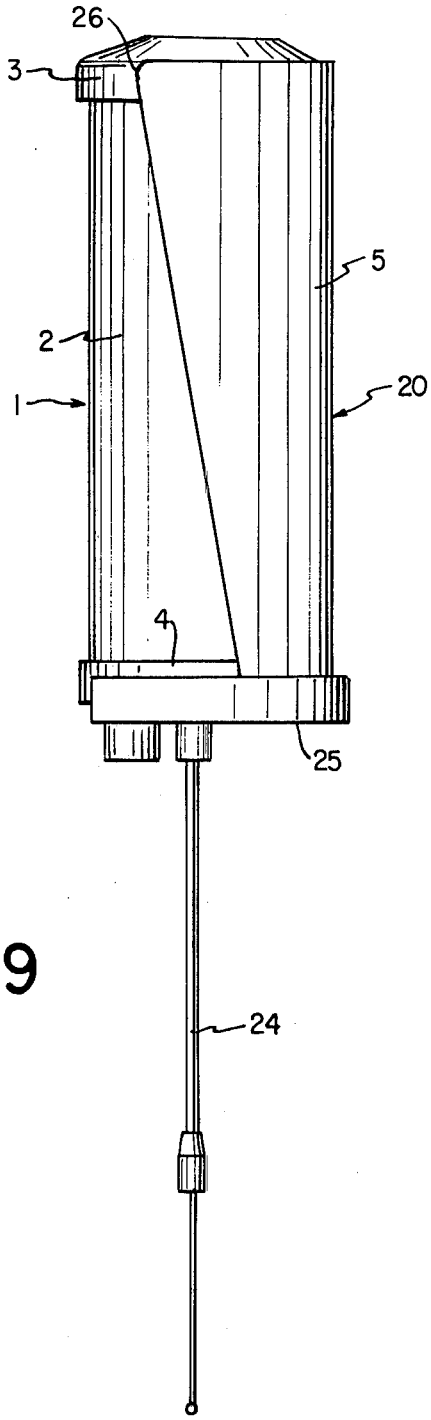
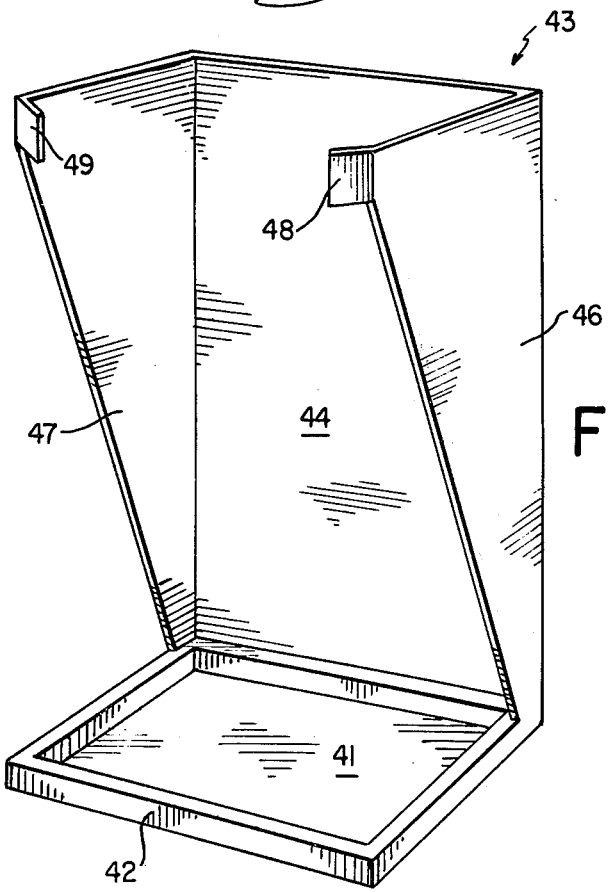
FIG. 9

AUTOMATIC FLOAT-OFF STORAGE BRACKET

BACKGROUND OF THE INVENTION

The present invention relates generally to storage brackets and more particularly to storage brackets allowing for automatic float-off of a buoyant stored object should the bracket and stored device become submerged.

It is desirable to install emergency equipment, such as radio locator transmitters or lighting devices, aboard certain maritime vessels so as to be released automatically for floatation should the vessel capsize or sink. This type of emergency equipment, as well as emergency oxygen supplies, fire extinguishers, and others, require stowage which is secure but which permits the stowed device to be removed easily. Many current types of stowage brackets use spring clips, clamps, latches, or other types of restraint. Such devices impede the extraction of the emergency units and thereby increase the time required to place the unit in use.

Summary of the Invention

Accordingly, it is an object of this invention to provide a storage device which securely holds various types of equipment in place and allows their rapid, unhindered, manual extraction. It is a further object of this invention to provide for automatic float-out of emergency devices, such as lights, radio transmitters, or other such devices installed upon vessels or structures, should the vessel sink or should said structures collapse into water.

Briefly, these and other objects are obtained by providing a mounting bracket to engage a module which has an enlarged upper portion, an elongated body portion, and a lower portion. The mounting bracket engages the upper and lower portions until after a first upward displacement of the module to then allow free lateral movement of the module. An upper retainer engages the enlarged upper portion of the module but will not engage the elongated body portion. The lower retainer engages the lower module portion until after an upward movement through a first distance. The upper retainer disengages the upper portion of the module after a displacement no greater than the first displacement. The retainers do not frictionally secure the module, but allow unhampered upward movement of the module within the bracket.

DESCRIPTION OF DRAWINGS

The invention is explained below with reference to the accompanying figures in which:

FIG. 6 is a perspective view of a modified bracket, for releasably holding a stored device having an extending axial rod, such as a radio transmitter with antenna;

FIG. 7 is a side elevation view of a radio transmitter module for use with the bracket of FIG. 5;

FIG. 9 is an elevation perspective view of a further rectangular form of bracket.

DESCRIPTION OF PREFERRED FORM OF INVENTION

Figure 1:
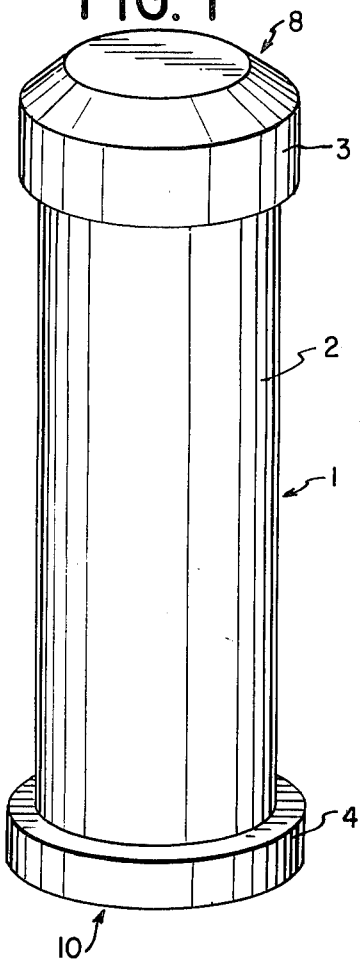
FIG. 1 is a perspective view of a module to be stored, illustrated as a radio transmitter.
Figure 2:
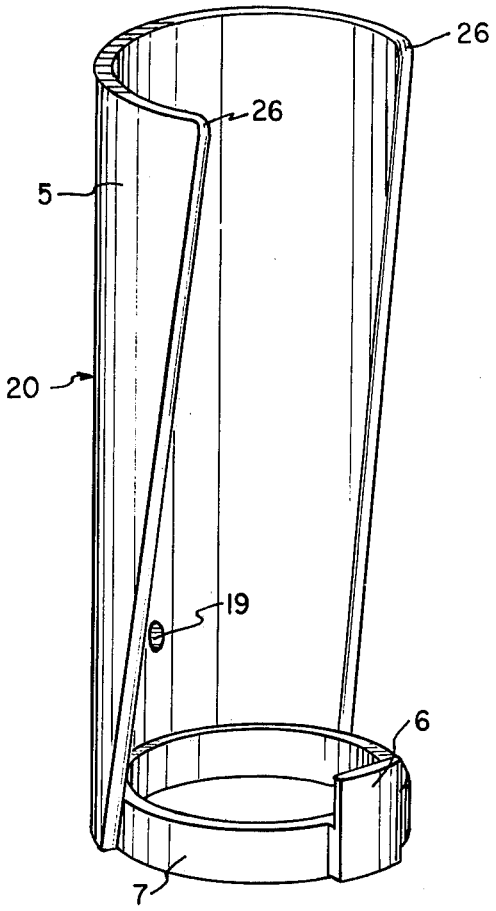
FIG. 2 is a perspective view of a storage bracket according to the invention.

In FIG. 1 is shown a representative form of stowed device 1 with a body 2 of generally cylindrical shape; its cross section is preferably circular, but may be oval, rectangular or of other form. Extending around body 2 is a ring 3 at the top 8 of the body 2 and a ring 4 at the bottom 10, these rings being larger in lateral dimension than the body 2.

Figure 3:
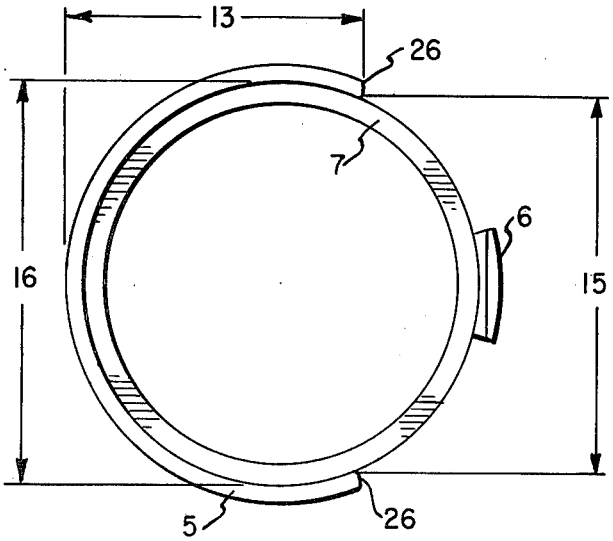
FIG. 3 is a top view of the bracket.
Figure 4:
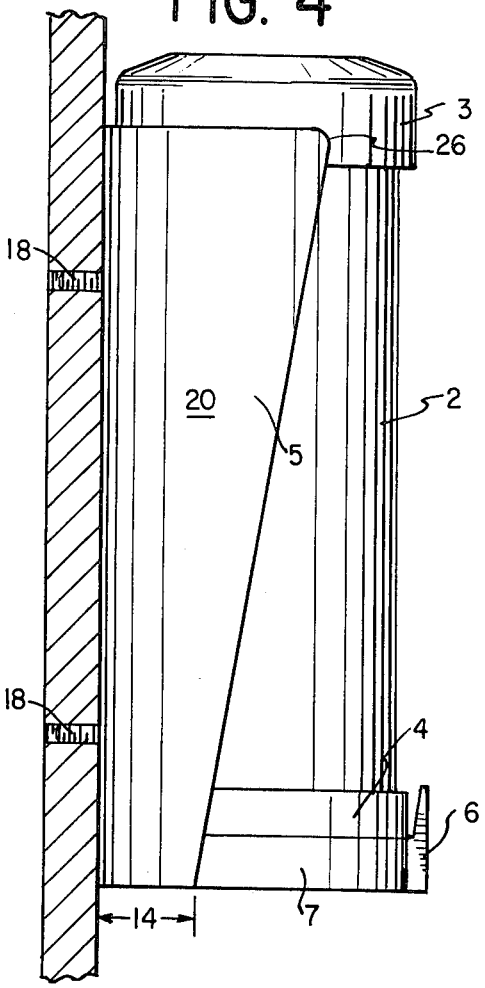
FIG. 4 is a side elevation view of the bracket and stored module.

The mounting bracket 20 for module device 1 is formed with an open cylindrical wall 5 of a cross-section adapted to slidably receive the module device to be stored, and a supporting base 7 upon which the module is normally intended to rest. The top of the mount 20 is open, and the side is cut away at a slant so that the wall of the mount near the top has a depth (designated by dimension 13 of FIG. 3) greater than half the inner diameter of the wall, with the separation between the edges of the cylindrical wall at this point (designated by dimension 15 in FIG. 3) less than the inner diameter (dimension 16) of the wall, while near the base 7, the depth (dimension 14) is less than a half-diameter (FIG. 4).

In this way, a ring such as 3 or 4 having an outer diameter substantially equal to the inner diameter of the mount would be freely movable sideways of the mount if near the lower end, but would be retained by the inwardly extending edges 26 of the mount wall near the upper end of the mount. The mount also has a retainer lug 6 extending upwardly from the base 7 at the mount front, to prevent outward or lateral movement of the module when resting on the base.

The dimensions of the device being mounted are chosen in relation to the mount so that, with the device inserted in the mount, the lower ring 4 will be supported on base 7 and would be able to move laterally frontward out of the mount, but for the retainer lug 6. The upper ring 3, however, would then be located within the upper part of the mount wall, and would be prevented from lateral movement by the partially encircling edges 26 of the upper portion of the mount. However, the device 1 is freely slidable axially upward within the mount 20, and the diameter of its body 2 is made smaller than the separation 15 between the edges 26. Also, the portion of the upper ring 3 within wall edges 26 is made shorter in height than the height of the retainer lug 6, so that if device 1 is raised from base 7 enough for lower ring 4 to clear retainer 6, the upper ring 3 is then raised enough to clear the upper end of the mount wall. Then lower ring 4 can move laterally out of the mount wall, and the body 2 can also pass through the opening between wall edges 26, so that the device 1 can move completely away and out of the mount.

The bracket 20 may be fastened in any desired manner to any suitable surface on the ship or other vehicle, e.g. screws 18 (FIG. 4) extending through holes 19 (FIG. 8) in the bracket wall 5 to said surface, advantageously on an outside wall when the stored module is a beacon device such as an automatically floating off radio transmitter or beacon light. Hence, the beacon device may readily become free in the case where the ship may sink or the bracket otherwise becomes submerged, even where the ship does not roll sufficiently to allow the supported module to fall outward of the mount. It will be understood that in these cases the supported module is preferably made floatable, so that, as discussed below, its buoyancy will assist in freeing it from the mounting bracket.

Figure 5:
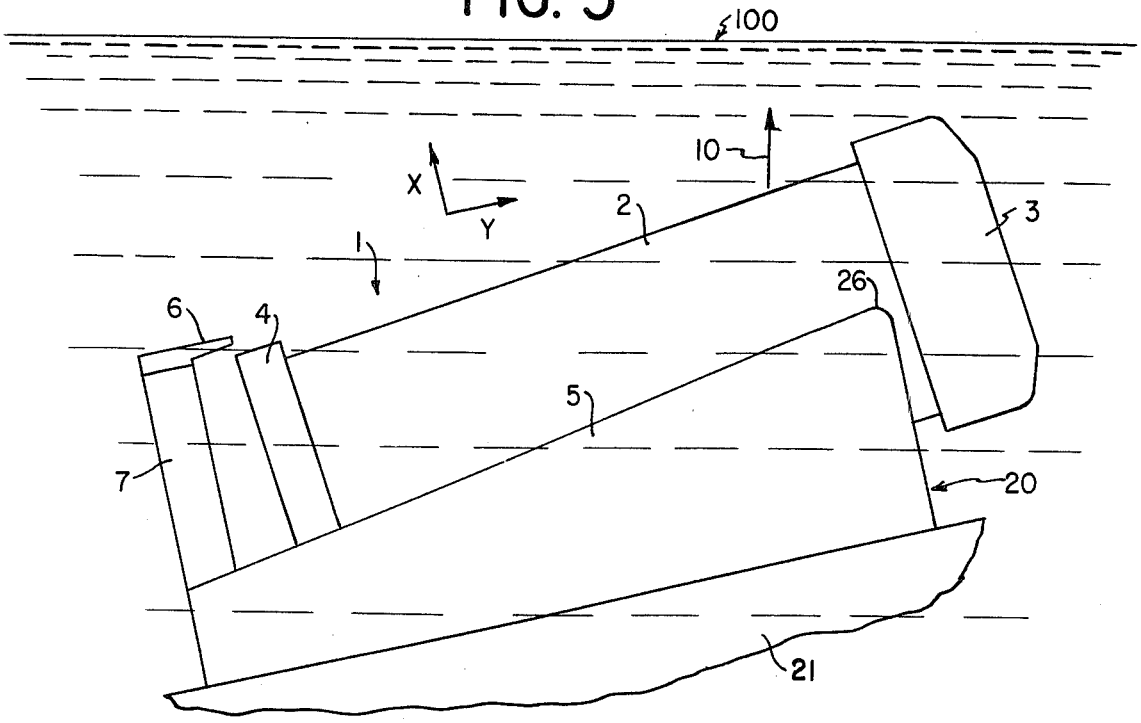
FIG. 5 is a side elevation view of the bracket while the module is being deployed.

FIG. 5 illustrates the manner in which the stored device or module 1 is released from the bracket mount 20 when the supporting surface is submerged, even though the ship may have rolled through a substantial angle. In FIG. 5, arrow 10 represents the buoyant force acting on floatable module 1 when submerged beneath the water surface 100. The force vector can be resolved into two components, component Y being parallel to wall 21 (and thus to the axis of bracket 20), and component X being perpendicular thereto. It will be seen that component Y acts on the module 1 to displace it axially upward within the bracket 20, away from the base 7, and generally into a position such as shown in FIG. 5. It will be observed that once the rings 3 and 4 have cleared their physical constraints imposed by cylindrical wall edges 26 and retainer 6, respectively, the stored module 1 is freed from the mount and the buoyant force 10 will act on the module 1 to cause it to move in the direction of the arrow 10; that is, because the diameter of body 2 is less than dimension 15, no physical restraints confine the module 1 within the bracket 20, and the module 1 is freed. It will be appreciated that bracket 20 is suitably secured to a portion of the ship where the module would be free to float to the surface.

It is also to be noted that the module is quickly and readily freed from the mount after only a very short axial movement. It is merely necessary for the module to lift away from the base by the distance of the height of retainer 6, rather than requiring the mount to pass through the entire length of the mount wall. This is highly advantageous since it provides a much quicker release of the module, which may be highly desirable if the supporting vessel rolls or pitches rapidly as it submerges.

It will also be seen that if the ship moves violently, as by a roll or pitch in excess of 90 degrees, and the module has not yet become submerged, it will slide freely out of the bracket under the influence of gravity. However, if the vessel becomes submerged, with an angle of pitch or roll less than 90 degrees, the stored module will float free of the bracket and be able to rise to the surface. Hence, this arrangement provides the maximum utility for releasing a beacon-type module from the ship in the event of serious difficulty.

Moreover, this arrangement permits the ready manual removal of the stored device when desired, merely by grasping its body portion through the open mount wall, and lifting the short distance represented by the height of the retainer 6, after which the stored device can be moved laterally to free it readily from the mount.

FIG. 6 shows an alternate embodiment of the mounting bracket. The cylindrical restraining wall 5 is secured at the bottom to a base surface 25, and is surrounded by a ring 27 having a retaining lip 28. The base surface 25 is in the form of a supporting disk which has a wedge-shape opening 29. Base 25 supports the module 1 shown in FIG. 7, which in this instance is illustrated as a radio transmitter with an antenna 24 which, when in the mounted position, extends below base 25 and through the wedge-shape opening 29 shown in FIG. 6. The module 1 has upper and lower rings 3 and 4 as in the previous form.

In this embodiment, the module is held normally by the cylindrical wall 5 and the lip 28 or ring 27. This embodiment operates essentially in the same manner as that previously described. However, due to the wedge-shape cutout from the supporting disk 25 and the ring 27, the antenna 24 may exit readily from the bracket in either float-away or gravity-influenced deployment.

Figure 8:
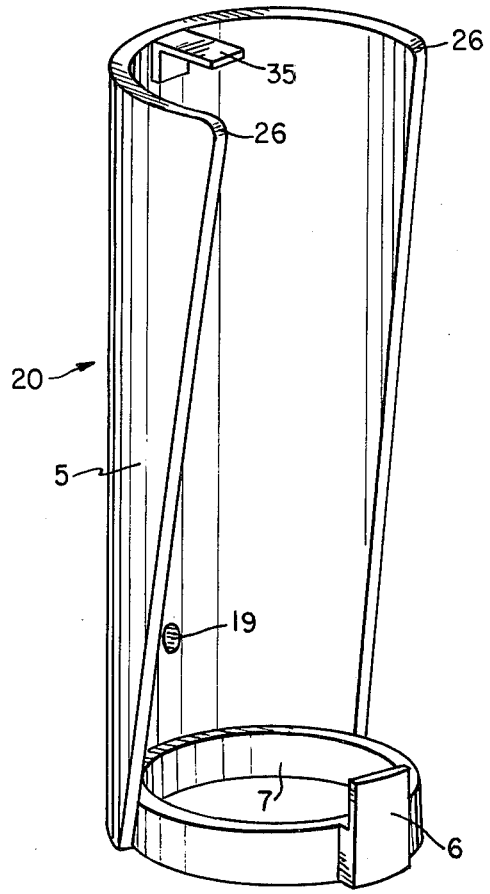
FIG. 8 is a perspective elevation view of a modified form of bracket.

In the further form shown in FIG. 8, the bracket 20 is provided with a horizontal restraining clip 35, which provides vertical restraint for module 1. When the bracket is used in conjunction with clip 35, it does not provide the automatic float-free feature, but clip 35 and mount 20 provide a convenient storage means without the use of hinges, straps, buckles or latches, while permitting simple manual extraction of the module from the mount. To deploy the module from this mount, one need only grasp the module through the mount wall and pull firmly. This causes the top of module 1 to pass through the opening between edges 26 of the side wall 5, which is preferably made of a flexible material, such as plastic or metal, which, when the module is pulled from the front, will yield sufficiently to allow the module ring 3 to pass through the opening 15 between the side wall edges 26. Then the module can be simply tilted or lifted to clear the bottom retainer 6 or 27.

As illustrated in FIG. 9, the module and its mount are not restricted to a cylindrical form. In this form the mount is generally rectangular, having a base 41 with a ring or lip 42 extending therearound to serve as a retainer in normal storage. Obviously, the lip may be discontinuous to form one or more retainers. The wall of the body portion 43 has a flat back 44 which can be mounted on the supporting surface, and two side walls 46 and 47 terminate at their upper ends in inwardly extending tabs 48, 49 and which taper downwardly in width. The module then has a cross-sectional shape bearing the same relationship to the mount as in the preceding cases.

It will be seen that in each instance the supporting wall of the mount can be formed very simply by a diagonal cut of an essentially cylindrical (of either circular or rectangular or other cross-section) wall. By way of examples, the circular form shown in FIGS. 1 through 8 may have a wall extending around an arc of about 135 degrees at the bottom, and around 200 degrees at the top, leaving an opening large enough for the body of the module to pass through.

It has been found that a module according to the invention is highly satisfactory over a substantial range of angles of tilt of the supporting surface, from vertical down to even as low as 5 degrees above the horizontal, with the open side of the mount facing either upwards or downwards.

It will be understood that in any of the forms of the invention, the body wall portions encircling the module may be made flexible, so that the module may be directly withdrawn by forcing it outwardly to cause the flexible wall portions to yield. In such cases, the module does not need to have enlarged end portions, but may be of uniform cross section. In such event, of course, a floatable module would have to move axially the entire length of the mount in order to float free.

It will be apparent that other modifications and variations in the arrangement described may be readily made without departing from the basic concept of the invention, which is defined by the appended claims.

What is claimed as the invention is:

1. A mounting device for holding and releasing a stored module of predetermined size, said module having an elongated body portion, a lower portion, and an enlarged upper portion, said mounting device comprising:

a base adapted to provide a support surface for the lower portion of said module, a lower retainer arrangement associated with said base and adapted to engage the lower portion of said module to prevent lateral movement of said module lower portion until said module is displaced a first predetermined distance upward from said base to allow unrestrained lateral movement of said lower portion despite said lower retainer arrangement, an upper retainer arrangement adapted to engage the upper portion of said module to prevent only lateral movement of said module upper portion until said module is displaced upward with respect to the mounting device a second predetermined distance no greater than said first predetermined distance, said upper retainer arrangement having a side opening of a dimension adapted to permit unrestrained lateral passage of the body portion of said module, after said upward displacement, whereby after movement upward by said first predetermined distance the module may freely move laterally through said side opening for complete disengagement from the mounting device.

2. A mounting device as in claim 1, further comprising an upright which joins said base and lower retainer arrangement with said upper retainer arrangement.

3. A mounting device as in claim 2, wherein said upright comprises a hollow open-ended wall portion of said mounting device adapted to contain said module slidably, said wall portion having a lower section with a side opening of a dimension adapted to permit lateral passage of the lower portion of said module, said upper retainer arrangement comprising an upper section of said wall portion with a side opening of a dimension adapted to permit lateral passage of the body portion of said module but to restrict lateral passage of the upper portion of said module, whereby said upper section of said wall portion is adapted to engage the upper portion of said module to prevent lateral movement of upper portion of said module until said module is displaced upward, relative to the mounting device by said second predetermined distance.

4. A mounting device as in claim 2, wherein said lower retainer arrangement comprises a sleeve of same crosssectional shape as the lower portion of said stored module, said sleeve having dimensions adapted to extend around and slidably engage said lower portion of said stored module.

5. A mounting device as in claim 4 wherein said base comprises a planar surface, and wherein said sleeve extends perpendicular to said surface toward said upper retainer arrangement, said sleeve extending around substantially the entire periphery of said planar surface, said planar surface including a wedge-shape opening and said sleeve including a matching opening extending vertically and in alignment with said wedge-shape opening to allow lateral passage of a downwardly extending rod secured to said module.

6. A mounting device as in claim 1, wherein said upper retainer arrangement is made of a flexible material which is adapted to yield, when force having a component laterally outward is applied to the upper portion of said module when engaged in said mounting device, to allow lateral passage of said upper portion through the side opening of said upper retainer arrangement.

7. A mounting device as in claim 6 further comprising a top retainer arrangement associated with said upper retainer arrangement and adapted to engage said upper portion of said module to prevent upward movement of said module relative to said mounting device.

8. In combination, a module to be releaseably supported having an elongated body portion, a lower portion, and an enlarged upper portion, and a mounting device for holding and releasing said module when stored in said mounting device, said mounting device comprising:

a base providing a support surface for the lower portion of said module device, a lower retainer arrangement associated with said base and engaging said module's lower portion to prevent lateral movement of the lower portion of said module until said module is displaced upward relative to the mounting device a first predetermined distance from said base to allow unrestrained lateral passage of said lower portion from said lower retainer arrangement, an upper retainer arrangement engaging the upper end of said module to prevent only lateral movement of upper portion of said module until said module is displaced upward relative to the mounting device a second predetermined distance no greater than said first predetermined distance, said upper retainer arrangement having a side opening of a dimension permitting lateral passage of the body portion of said module, after said upward displacement, whereby after movement upward relative to said mounting device by said first predetermined distance the module may move laterally through said side opening for complete disengagement from the mounting device.

9. The combination as in claim 8, wherein said mounting device further comprises an upright which joins said base and lower retainer arrangement with said upper retainer arrangement.

10. The combination as in claim 9, said upright and upper retainer arrangement comprising a hollow open-ended wall portion of said mounting device adapted to contain said module slidably, said wall portion having a lower section with a side opening of a dimension permitting lateral passage of the lower portion of said module, said wall portion also having an upper section with a side opening of dimension permitting lateral passage of the body portion of said module but restricting lateral passage of the upper enlarged portion of said module, and wherein said upper section of said wall portion engages the upper portion of said module to prevent lateral movement of upper end of said module until said module is displaced upward relative to the mounting device by said second predetermined distance.

11. The combination as in claim 10, wherein said lower retainer arrangement of said mounting device comprises a sleeve of the same cross-sectional shape as said lower portion of said stored module, and extending around and engaging said lower portion of said stored module, said sleeve having a height substantially equal to said first predetermined distance.

12. The combination as in claim 11, wherein said mounting device base comprises a planar surface, and wherein said sleeve extends perpendicular to said surface toward said upper retainer arrangement, said sleeve extending around substantially the entire periphery of said planar surface, said planar surface including a wedge-shape opening and said sleeve includes a matching opening extending vertically and in alignment with said wedge-shape opening to allow lateral passage of a downwardly extending rod secured to said module.

13. The combination as in claim 10, wherein said upper retainer arrangement of said mounting device is made of a flexible material which yields, when force having a component laterally outward is applied to the upper portion of said module engaged in said mounting device, to allow lateral passage of said upper portion through said upper retainer arrangement.

14. The combination as in claim 13, wherein said mounting device further comprises an additional top retainer arrangement associated with said upper retainer arrangement and engaging said top portion of said module to prevent upward movement of said module relevant to said mounting device.

15. A mounting device holding and releasing a floatable stored module of predetermined size upon submersion thereof, where said module has an elongated body portion, a lower portion, and an enlarged upper end portion, said mounting device comprising:

a base adapted to provide a support surface for the lower end of said module, a hollow open-ended wall portion secured to said base and adapted to slidably contain said module, said wall portion having a lower section with a side opening of a dimension permitting lateral passage of the lower end of said module, said wall portion also having an upper section with a side opening of a dimension permitting lateral passage of the body portion of said module and permitting unrestrained upward movement of said module in said mounting device but restricting lateral passage of the upper enlarged end of said module, a retainer arrangement associated with said base for engaging said module lower end to prevent lateral movement thereof through said lower wall section opening until said module is moved upwardly a predetermined distance from said base, said upper module enlarged and being positioned opposite said wall portion upper opening when said module is within said wall portion resting on said base and being displaced from said wall portion upper opening when said module is moved upwardly by said predetermined distance, whereby after said upward movement said module may move laterally through both said wall openings for complete disengagement from said mounting device.

* * * * *